United States Patent [19]

Nicholson

[11] 4,270,702

[45] Jun. 2, 1981

[54] ADJUSTABLE ORIFICE AIR KNIFE

[75] Inventor: Charles B. Nicholson, Glens Falls, N.Y.

[73] Assignee: Albany International Corp., Menands, N.Y.

[21] Appl. No.: 900,141

[22] Filed: Apr. 26, 1978

[51] Int. Cl.[3] ..... B05B 1/32

[52] U.S. Cl. ..... 239/455; 239/546; 239/562; 239/568; 239/597

[58] Field of Search ..... 239/455, 546, 562, 568, 239/597

[56] References Cited

U.S. PATENT DOCUMENTS

| | | | |
|---|---|---|---|
| 1,038,340 | 9/1912 | Gailor | 239/455 X |
| 1,698,822 | 1/1929 | Paxton | 239/455 X |
| 2,895,683 | 7/1959 | Dvorak | 239/568 X |
| 2,940,418 | 6/1960 | Penrod et al. | 239/455 X |
| 3,141,194 | 7/1964 | Jester | 239/590.3 X |
| 3,375,981 | 4/1968 | Keck | 239/546 X |
| 3,750,955 | 8/1973 | Nakai et al. | 239/597 |

*Primary Examiner*—Richard A. Schacher
*Attorney, Agent, or Firm*—Charles R. Hoffmann

[57] ABSTRACT

An adjustable orifice fluid knife utilizing a fluid such as air and including a supporting structure adapted to be connected to a source of fluid. A passage network is on the supporting structure terminating in an opening for transmittal of fluid from the fluid source and out of the opening. A nozzle assembly is on the supporting structure in alignment with the opening for directing the flow of fluid therefrom in a controlled high velocity stream capable of acting as a knife. The nozzle assembly includes a fixed plate on one side of the opening at a predetermined angle with respect to the opening. A bar assembly is on the opposite side of the opening and includes an adjustable blade on the bar assembly responsive to adjustment structure to be angularly shifted with respect to the opening and the fixed plate to a variety of different positions along its length thereby providing for a range of orifice sizes along the length of the blade in alignment with the opening for passage of fluid therethrough.

9 Claims, 2 Drawing Figures

ADJUSTABLE ORIFICE AIR KNIFE

BACKGROUND OF THE INVENTION

Fluid knives, particularly air knives, air showers and the like are in common use in many different environments. For example, when air is used for treatment purposes at a high velocity in a controlled manner, an air knife becomes very helpful. For example, in carpet manufacture, air is used in dewatering as well as to blow gently across the tufting to cause the fiber to stand upright.

In the papermaking field an air knife becomes extremely useful particularly in regard to the wet end of a papermaking machine such as for purposes of a sheet knock-off. Also, at the dry end of the papermaking process, an air knife is adaptable for use in felt cleaning and drying as well as in coating procedures.

The one difficulty existing with air knife structures has been in the area of orifice adjustment. Generally they utilize a structure such as a large bolt every foot or so to force open or close two angle pieces. This type of arrangement is not adaptable for a uniform orifice sizing or for close control over orifice adjustment particularly at different points along the length of an extended orifice arrangement.

Examples of prior art in this area are present in U.S. Pat. Nos. 1,759,804 and 3,977,359 where the art of deckling is utilized to control the length of orifice openings.

Furthermore, U.S. Pat. No. 3,977,359 goes into greater detail as to the advantages of having a greater air flow at the ends than at the center when blowing hot metal, such as zinc, off a sheet or strip of base metal. In this teaching, the concept is accomplished by using adjustable air jets internally to control air flows. Other references of interest include U.S. Pat. No. 1,625,472 directed to a pulp web cutter; U.S. Pat. No. 2,610,555 directed to a pair of bar cutters for welting at right angles and U.S. Pat. No. 3,841,910 a general teaching of a method and apparatus for extracting from traveling porous webs.

In general, the background shows that air knifes are used in a variety of different environments for different purposes. However, it is also apparent that there are considerable limitations as to the control over orifice openings particularly with respect to the concept and flexibility of orifice adjustment and variability of orifice openings over an elongated slot or aperture.

SUMMARY OF THE INVENTION

With the above background in mind, it is among the primary objectives of the present invention to provide an adjustable orifice fluid knife, particularly an air knife, which has means for closely controlling the orifice opening and in fact provides for adjustment over an elongated orifice whereby the openings can be varied at different points along the length. Cost savings are also involved in that the controlled orifice structure is provided at a considerable reduced manufacturing, installation, and use cost. Of considerable significance is the fact that there is no need for rigidity to guarantee orifice adjustment. The system of the present invention is simple and versatile and no additional structure such as deckling is required to close down the length of an opening or any portion thereof. In the present invention, decrease or increase of the opening at any point can be obtained without the necessity of additional attachments.

It is an objective to provide the present inexpensive and easily adjustable air knife system for use in a variety of environments. It is particularly useful at the wet end of a papermaking machine for activities such as sheet knock-off. Additionally at the dry end of the papermaking machine, it can be used for felt cleaning and drying as well as in coating.

In summary, an adjustable orifice fluid knife is provided including a supporting structure adapted to be connected to a source of fluid. A passage network is on the supporting structure and terminates in an opening for transmittal of fluid from the fluid source and out of the opening. A nozzle assembly is on the supporting structure in alignment with the opening for directing the flow of fluid therefrom in a controlled high velocity stream capable of acting as a knife. The nozzle assembly includes a fixed plate on one side of the opening at a predetermined angle with respect to the opening. A bar assembly is on the opposite side of the opening and includes an adjustable blade on the bar assembly responsive to adjustment means to be angularly shifted with respect to the opening in the fixed plate to a variety of different position along its length thereby providing for a range of orifice sizes along the length of the blade in alignment with the opening for passage of fluid therethrough.

With the above background in mind, reference is made to the attached drawing.

DETAILED DESCRIPTION

Air knife 20 is of the type as shown which can be interconnected with a variety of different type of processes for utilizing a fluid or air knife system. Naturally other fluids can be used in place of air, however, air is a common medium particularly in fields such as papermaking processes for a variety of purposes. For example, it is adaptable for use at the wet end of a papermaking machine for activity such as sheet knock-off. Alternatively, it could be used at the dry end of the process for felt cleaning and drying as well as coating. Other environments such as carpet manufacture are also usable environments in which case the air would be used for purposes such as dewatering as well as to blow gently across the tufting and cause the fibre to stand upright.

In any event, the structure of the fluid or air knife includes an elongated hollow pipe 22 with means at either or both ends for connection to a source of fluid (not shown). For purposes of description of the depicted embodiment, air will be used as the fluid employed. The working knife portion is captured between two annular flange stops 24 and 26 spaced along the length of pipe 22 and defining the limits of the air knife range of structure.

Figure 1:
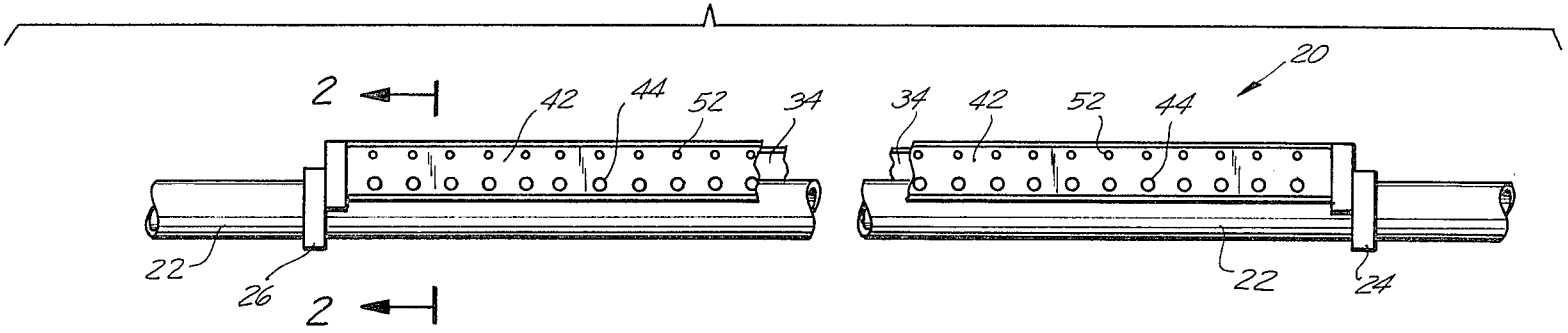
FIG. 1 is a fragmentary plan view of the air knife of the invention.
Figure 2:
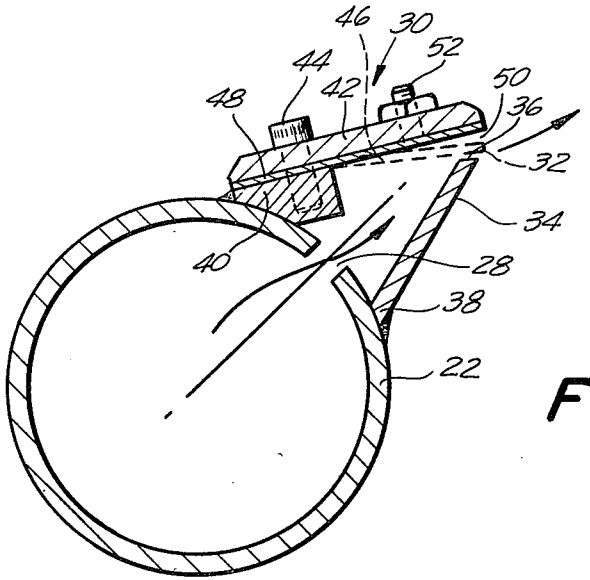
FIG. 2 is an enlarged sectional end view thereof taken along the plane of line 2—2 of FIG. 1.

Between limits 24 and 26 pipe 22 has a series of drilled holes 28 which forms an opening for passage of the air therethrough in a radial direction. As the air exits through holes 28, as depicted in FIG. 2, it enters a chamber in a nozzle structure 30 which terminates distal from holes 28 in a narrow orifice 32 which results in a rapid stream of air therefrom in the direction shown by the arrow in FIG. 2 to act as an air knife. This occurs along the length of the air knife structure between stops 24 and 26.

The nozzle structure 20 includes an angled fixed plate 34 having a free beveled edge 36 and its other end 38 mounted to the outer surface of pipe 22 in a conventional manner such as by welding. The plate 34 extends along the length of the air knife structure and is opposed by a combination structure on the opposite side of the holes 28. The composite structure includes a base or inner bar 40 mounted in a conventional manner to the outer surface of the pipe such as by welding and angled obliquely toward the fixed plate 34 and the holes 28. The inner fixed bar 40 is interconnected with an outer flat bar 42 by means of a plurality of spaced screws 44 which pass through aligned, appropriately threaded apertures in the inner and outer plates. The screws 44 are spaced at predetermined intervals along the length of the plates between end stops 24 and 26 of the structure.

Outer bar 42 is of larger width than inner bar 40 and extends beyond the bar 40 a predetermined distance and is angled toward opening 28 and toward fixed plate 34.

Captured between bars 40 and 42 is a flexible adjustable blade 46 which is formed of a conventional flexible and resilient material such as spring stainless steel. Blade 46 has a fixed end portion 48 captured between bars 42 and 40 and by means of screws 44 passing through aligned apertures in the two bars and the blade. The opposite end 50 of the flexible blade is free for movement between engagement with the undersurface of outer bar 42 and the terminal free end 32 of fixed plate 44.

Shifting of end portion 50 is accomplished by means of a plurality of adjustment screws 52 spaced along the length of outer bar 42 at predetermined intervals to form individual adjustment means for the air knife. Adjustment is accomplished by threading each screw 52 inward and outward with respect to a threaded aperture in outer bar 42 and thus through engagement with free end portion 50 of the blade either biasing the blade toward blade 34 or releasing the blade to return toward the relaxed configuration into engagement with the undersurface of bar 42. An alternative position for free end portion 50 is depicted in phantom in FIG. 2 where the blade at one particular point along the length of the air knife has been shifted to close proximity with free end 32 of fixed plate 31 resulting in a very narrow orifice for flow of air from the air knife structure.

In operation, once the ends of pipe 22 has been interconnected with the source of air, appropriate adjustments can be made along the entire length of the air knife structure between end stops 24 and 26 at all locations of screws 52 so as to provide a uniform orifice along the length of the knife or to form larger or smaller orifices in certain areas depending upon individual adjustments. It has been found effective to space the adjusting screws 52 at 2 inch intervals along the adjustment bar. By turning the screws 52 inward, pressure is applied at any given point along the free end 50 of blade 46 and any desired orifice is obtained, either uniform or for any reason, larger or smaller orifices in particular areas along the length of the structure. Not only is it possible to regulate the orifice sizing but through adjustment the orifice area can be closed off completely at any point or points along the length of the orifice.

It is contemplated that the structure can be formed of well known steel or rigid plastic materials with flexibility being necessary only in connection with blade 46. As stated above, flexible stainless steel has been found to work effectively for this purpose.

The structure is simple in construction, utilizes minimum components and is easily installed and operated. Adjustment is accomplished by the use of a simple tool to operate adjustment screw 52 at any point along the length of the structure to thereby provide closely controlled orifice adjustment at a variety of points along the length of the structure. The concept and flexibility of orifice adjustment includes the provision of a much better controlled orifice at a considerable cost savings. There is no need for rigidity to guarantee orifice adjustment. No additional structure is needed other than the simple arrangement of components as depicted and as described above. The versatility of the structure is readily apparent particularly in respect to the ability to decrease or increase the opening at any point without the necessity of added attachments.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. An adjustable orifice fluid knife comprising; a supporting structure adapted to be connected to a source of fluid, a passage network on the supporting structure terminating in an opening for transmittal of fluid from the fluid source and out of the opening, a nozzle assembly on the supporting structure in alignment with the opening for directing the flow of fluid therefrom in a controlled high velocity stream capable of acting as a knife, the nozzle assembly including a fixed plate on one side of the opening at the predetermined angle with respect to the opening and a bar assembly on the opposite side of the opening and including an adjustable blade of very thin highly flexible spring-like material on the blade assembly responsive to adjustment means at closely spaced points to be angularly substantially flexed with respect to the opening and the fixed plate to a variety of different positions at the same time at different closely spaced points to provide an adjustable variable gap along its length with each point being adjustable independent of other points along the length thereby providing simultaneously for a non-uniform range of orifice sizes between open and closed position along the length of the blade and within a short portion thereof in alignment with the opening for passage of fluid therethrough.

2. The invention in accordance with claim 1 wherein the fluid is air.

3. The invention in accordance with claim 1 wherein the supporting structure includes an elongated hollow pipe with means at least one end for connection to a source of fluid, the opening being a series of drilled holes along the length of the pipe at a predetermined location about its circumference.

4. The invention in accordance with claim 1 wherein the adjustable blade on the nozzle assembly is a flexible elongated plate fixed at one end and having a free end adapted to be directed by the adjustment means toward and away from the fixed plate.

5. The invention in accordance with claim 1 wherein the bar assembly portion of the nozzle assembly includes an inner bar mounted in fixed position on the supporting structure, an outer bar removably mounted to the innter bar and extending outwardly therefrom, the adjustable blade being spring-like and mounted adjacent one edge between the inner and outer bars and extending outwardly therefrom in alignment with the undersurface of the outer bar, and the adjustment means being in position to deflect the free outer end of the spring-like adjustable blade toward and away from the fixed plate on the other side of the opening thereby providing for adjustment of orifice size.

6. The invention in accordance with claim 1 wherein the adjustment means is in the form of at least one screw threadedly engaged with an aperture in the outer bar and in position to be threaded toward and away from the spring-like adjustable blade so as to engage with the adjustable blade and direct it toward and away from the fixed plate on the other side of the opening.

7. The invention in accordance with claim 1 wherein the adjustment means is a plurality of spaced adjustment screws along the length of the outer bar with each screw being individually adjustable thereby providing for adjustment at a variety of different points along the length of the adjustable blade and thereby obtaining any desired orifice uniformly along the blade or of different orifice sizes at different points along the blade.

8. The invention in accordance with claim 7 wherein the fixed plate is an elongated member welded to the surface of the supporting structure adjacent to one side of the slot in the pipe forming the opening, the inner bar being an elongated bar welded to the supporting structure on the opposite side of the slot forming the opening from the location of the fixed plate, the outer bar being an elongated bar overlying the inner bar and having the elongated adjustable flexible blade sandwiched therebetween with the inner and outer bars and intermediate blade being interengaged by means of a plurality of spaced locking screws along the length of the bars.

9. The invention in accordance with claim 1 wherein the adjustable orifice fluid knife is positioned adjacent the wet end of a papermaking machine including a sheet on a forming wire so that the fluid knife is capable of knocking the sheet from the forming wire.

* * * * *